United States Patent [19]

McNew

[11] 4,270,911

[45] Jun. 2, 1981

[54] METHOD AND SYSTEM FOR PROVIDING ELONGATED Z-FOLD COPY PAPER

[76] Inventor: Thomas A. McNew, 4229 Royal Avenue, Oklahoma City, Okla. 73108

[21] Appl. No.: 104,445

[22] Filed: Dec. 17, 1979

[51] Int. Cl.[3] ..... B65H 45/00; B65H 45/20

[52] U.S. Cl. ..... 493/410; 493/413; 493/448; 355/35 H; 355/145 H; 428/130; 428/169

[58] Field of Search ..... 270/52.5, 61 F, 73, 270/79, 86; 355/35 H, 145 H, 75; 428/130, 169, 176, 181; 83/879-887, 674, 678, 695

[56] References Cited

U.S. PATENT DOCUMENTS

| | | | |
|---|---|---|---|
| 3,104,799 | 9/1963 | Steidinger | 229/69 |
| 3,245,311 | 4/1966 | Cerasani | 355/75 |
| 3,325,188 | 6/1967 | Hiersteiner | 282/11.5 |
| 3,406,959 | 10/1968 | Ross | 270/73 |
| 3,500,517 | 3/1970 | Dekker | 83/866 |
| 3,701,522 | 10/1972 | Chi | 270/86 |
| 4,086,007 | 4/1978 | Smith | 355/35 H |

*Primary Examiner*—Edgar S. Burr
*Assistant Examiner*—A. Heinz
*Attorney, Agent, or Firm*—William R. Laney

[57] ABSTRACT

A method and system for producing elongated Z-fold copy paper having indicia emplaced thereon by xerographic reproduction. The method entails initially transversely scoring and folding an elongated sheet of paper at spaced intervals therealong with alternate adjacent score-fold lines being originated by pressures exerted on respectively opposite sides of the paper. The elongated scored sheet is then rolled up in a cylindrical roll, and is fed from this roll to a copying machine into close proximity to a rotating xerographic copying drum within the machine. After emplacement of indicia on the paper in the reproduction process, the paper may then be rolled up on a storage roll or Z-folded manually or by suitable apparatus.

The apparatus used to produce the elongated Z-fold copy paper includes a first paper feed subassembly for feeding an elongated sheet of paper from a roll into a perforating machine, a perforating machine for alternately perforating opposite sides of the sheet of paper at spaced intervals therealong, and including a first perforating element and a second perforating element spaced from the first perforating element, a paper rolling machine for rolling the perforated paper into a cylindrical roll upon receipt of the perforated paper from the perforating machine, a roll feeding subassembly for feeding perforated paper from the roll to a xerographic drum-containing copying machine, and a xerographic drum-containing copying machine for receiving the perforated paper from the roll feeding subassembly.

11 Claims, 4 Drawing Figures

METHOD AND SYSTEM FOR PROVIDING ELONGATED Z-FOLD COPY PAPER

BACKGROUND OF THE INVENTION

1. Field of the Invention

This invention relates to xerographic and electrostatic copying processes, and more particularly, to processes by which indicia are placed on an elongated sheet of paper by such processes, and the elongated sheet is then subsequently Z-folded for storage and use of the imprinted indicia.

2. Brief Description of the Prior Art

Some types of widely used documents are printed upon elongated sheets of paper which are fan-folded or Z-folded for convenience of storage. By fan-folded or Z-folded paper is meant paper which is folded alternately about a score line or fold line in first one direction, and then in the opposite direction so that accordian-like pleats are formed in the sheet of paper, and the document can be compactly stored in folded form. Documents which are frequently stored in this form include computer printouts, electrocardiograms, business and accounting tabulations and well logs developed in the exploration and production of oil and gas.

It is often desirable that Z-folded documents of the type described be copied or reproduced. In the past such reproduction has usually been accomplished photographically. Efforts to copy elongated fan-folded documents of indeterminate length, such as well logs and electrocardiograms, using conventional copying machines which employ the xerographic process have encountered difficulty and have been time-consuming, since these machines are generally adapted to copy letter or legal size documents onto copy paper of the same size, and are not adapted for continuously feeding the elongated, fan-folded original document and the copy paper onto which the indicia from such documents is to be copied. In my co-pending U.S. patent application Ser. No. 907,922 filed May 22, 1978, now U.S. Pat. No. 4,185,760, I have disclosed a system which enables an elongated fan- or Z-folded original document to be continuously fed to a xerographic copying machine concurrently with the continuous feed of copy paper from a roll supported adjacent the copying machine. This system has been successfully employed to permit copies of the elongated Z-folded originals to be made in an expeditious and efficient manner.

It has been necessary, however, when using the system disclosed in my U.S. patent application Ser. No. 907,922, to further process the completed copies so as to place them in the Z-fold or fan-fold configuration in which such documents are customarily used and stored. In most facilities where copying in this fashion has been carried out, folding of the completed copies into the Z-fold or fan-fold configuration has been carried out manually. Such manual folding requires the exercise of care to be certain that each fold line is formed in the right place, since, unless the fold line extends precisely transversely of the elongated sheet, subsequent folding is out of alignment, and the completed fan-fold document is unsightly and does not fold up neatly to the compact form sought.

BRIEF DESCRIPTION OF THE PRESENT INVENTION

The present invention provides a method and a system for producing elongated fan-folded or Z-fold copies developed by a xerographic or electrostatic reproduction process from original documents of the same character, with the fold lines utilized being preformed in the elongated copy paper prior to the time it is passed continuously through a xerographic reproducing machine.

The method entails initially transversely folding an elongated sheet of 16–32 pound bond paper of indeterminate length at longitudinally spaced intervals therealong with transversely extending fold lines. Adjacent fold lines are originated by applying pressure on respectively opposite sides of the paper, so that the angles defined by the folds in the paper alternately open toward opposite sides of the paper or, stated differently, a fan-fold or Z-fold memory is imparted to the paper by this prefolding process. The prefolding described is achieved by perforating the paper along score lines which extend transversely of the elongated sheet at the described locations.

After scoring and crimping the elongated sheet, it is rolled up in a cylindrical roll preparatory to feeding it from this roll to a xerographic or elecrostatic copying machine. In the copying machine, the scored paper is directed into close proximity to a rotating copying drum. After transfer of indicia from the original document being copied to the elongated copy sheet, the scored copy paper can be rolled up on a storage roll, or Z-folded manually or by suitable apparatus.

A preferred embodiment of an apparatus used to produce the elongated Z-fold copy paper includes a first paper feed subassembly which feeds an elongated sheet of paper from a roll into a perforating machine, which alternately transversely perforates and crimps opposite sides of the sheet of paper at longitudinally spaced intervals therealong, and then into a paper rolling machine for rolling the thus perforated paper into a cylindrical roll upon receipt of the perforated paper from the perforating machine. Preferably, the apparatus also includes an auger or spiral type folding device positioned between the perforating machine and the paper rolling machine.

An important object of the present invention is to achieve, by the process of the present invention, an improvement in the completeness and fidelity of indicia transfer to an elongated copy paper of indeterminate length in instances where the copy paper is pre-stressed to impart a fan-fold memory to the paper prior to feeding it through a xerographic copying machine.

A further object of the invention is to provide a transversely scored roll of copy paper which can be fed to a xerographic copying machine for the purpose of transferring indicia thereto from an original document without concern that such transfer will be imperfect, or will leave holidays or voids adjacent the score lines as the copy paper moves through the copying machine.

A further object of the invention is to provide a straight-forward and simple process by which the ease and accuracy with which an elongated copy of an original document can be manually folded into a neat fan-folded form for storage of the copy.

Additional objects and advantages of the invention will become apparent as the following detailed description of the invention is read in conjunction with the accompanying drawings which illustrate a preferred embodiment of the invention.

DETAILED DESCRIPTION OF A PREFERRED EMBODIMENT OF THE INVENTION

Figure 1:
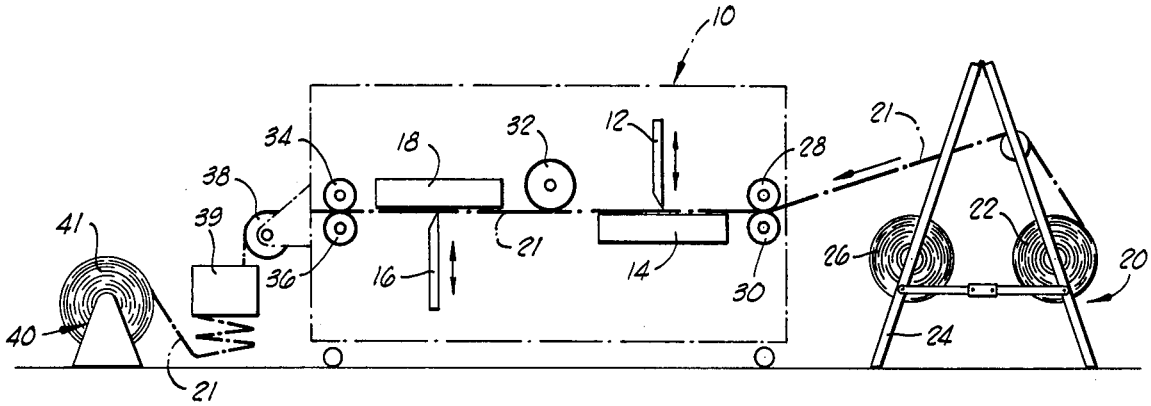
FIG. 1 is a diagrammatic illustration of a paper perforating apparatus and prefolding apparatus showing their use in conjunction with a paper feeding subassembly for feeding an elongated sheet of paper to the paper perforating apparatus. A paper rolling subassembly is illustrated positioned to receive perforated paper from the prefolding apparatus and roll it into a roll.

Referring initially to FIG. 1 of the drawings, illustrated therein is a conventional perforating machine 10, such as a tandemer press or web press, which can be utilized for perforating an elongated sheet of paper at longitudinally spaced intervals along the sheet, with the perforations being alternately formed on opposite sides of the sheet. To facilitate such perforating operation, a first reciprocating knife 12 having a serrated lower perforating edge is positioned above the path of a sheet of paper as the paper is supported on a back-up pad 14. A second reciprocating perforating knife 16 having a serrated upper edge is reciprocated against the underside of the paper sheet which is backed up by a back-up pad 18 beneath which the sheet is passed. Machines which function in the manner described are commercially available.

For the purpose of feeding an elongated paper sheet to the perforating machine 10 a paper feed subassembly 20 of the type illustrated and described in my co-pending application Ser. No. 907,922, filed May 22, 1978, can be utilized and functions to continuously feed an elongated sheet of paper 21 from a roll 22 carried on a suitable frame 24. A stand-by or spare roll of paper 26 may be provided on the same frame in accordance with the teachings of my co-pending application.

In the practice of the invention, an elongated sheet of bond paper having a weight in the range of from 16 to 32 pound bond is utilized. The elongated sheet of paper 21 is drawn into the perforating machine by a pair of cooperating feed rollers 28 and 30. A guide roller 32 is provided between the cushioning pads, and a pair of discharge rollers 34 and 36 are provided downstream from the reciprocating perforating knife 16 and cushioning pad 18 near the discharge end of the perforating machine 10. The perforated paper sheet is passed out of the machine 10 over an idler roller 38, thence through an auger or spiral type folder 39, and finally to a paper rolling subassembly 40 which can be driven by any suitable drive device, such as a motor or engine, to roll up the perforated and prefolded paper into a roll 41.

Figure 2:
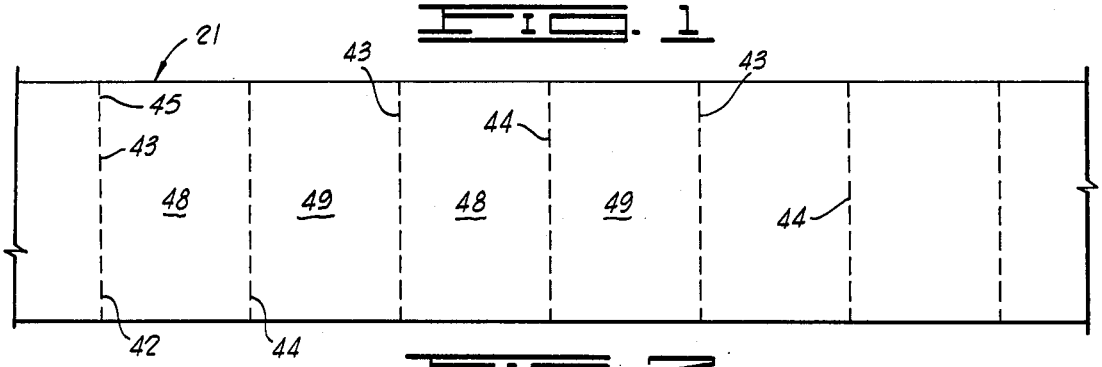
FIG. 2 is a plan view of an elongated paper sheet which has been perforated in the perforating apparatus depicted in FIG. 1.

As the elongated sheet of paper 21 is fed through the perforating machine 10, a score line 42 having the appearance illustrated in FIG. 2 is formed in the paper by downward reciprocation of the first perforating knife 12 which contacts the upper surface of the paper and forms this score line transversely across the sheet of paper. The scoring of the paper is such that, in a preferred embodiment of the invention, the open spaces or perforations 43 formed by the serrated edge of the perforating blade 12 cumulatively occupy from about 50 percent to about 80 percent of the total width of the paper sheet 21 and the solid, interconnecting, unsevered web portions 45 of the sheet between adjacent perforations cumulatively occupy the remainder of the total width of the sheet, or stated differently, of the total length of each score line.

The paper sheet 21 continues to pass through the perforating machine 12 and over the second perforating blade 16. In a timed sequence, the perforating blade 16 is reciprocated upwardly so that its serrated upper edge contacts the lower side of the sheet 21 and forms a transverse score line 44 which is originated from the lower side of the sheet. The score line 44 is perforated to the same extent as the score line 42 in relation to the web portions which are unperforated and lie between adjacent perforations.

Figure 3:
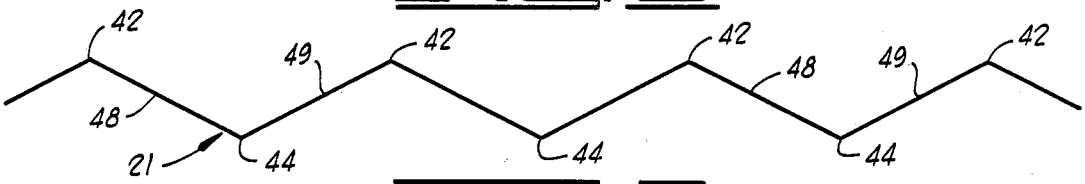
FIG. 3 is a side elevation view of the perforated paper sheet depicted in FIG. 2 showing the direction the paper tends to fold as a result of the perforations and pre-formed stress lines or crimps placed therein.

The sequence and spatial arrangement of score lines formed by the two perforating blades 12 and 16 is repeated so that the paper sheet 21 is alternately scored from above and then below to form repeating, longitudinally spaced, transversely extending score lines. Concurrently the paper is crimped or indented from opposite sides. The result of the scoring or perforating operation carried out on a sheet in this fashion is to provide a sheet having a Z-fold memory, or, stated differently, one which tends to fold in the manner shown in FIG. 3. Thus, at each score line, the direction of extension of the sheet is reversed, and alternate panel sections 48 and 49 between score lines tend to lie in parallel planes. The result is what is termed a fan-fold, Z-fold, accordian or pleat fold of the type characteristic of some types of documents hereinbefore described (i.e., well logs, computer printouts and the like). In the finally folded paper the panels 48 and 49 are precisely superimposed, one upon the other.

The process of the invention which has been thus far described is essentially that which has been heretofore carried out for the purpose of producing transversely scored Z-fold sheets. That is to say that it has been known to score the elongated paper sheet on opposite sides thereof to produce a sheet which tends to fold more easily into a Z-fold than into another and different folded configuration.

For the purpose of extending the described process to encompass an important aspect of the present invention, the paper sheet 21, scored in the manner described in the scoring or perforating machine 10, is discharged from the machine over the idler roller 38 and, after passage through an auger and spiral type folder device 39, is wound up into a cylindrical roll 41 as illustrated in FIG. 1. The use of the folder device 39 is optional, though preferred, and its function will be hereinafter described. The operation of rolling the scored paper sheet into the cylindrical roll 41 tends to draw the sheet relatively taut and, in doing so, to flatten out the portions of the sheet adjacent each of the score lines into an uncrimped configuration. After the cylindrical roll 41 has been completed, the general procedure described in my co-pending application Ser. No. 907,922 is carried out to use the thus perforated paper as the facsimile paper or paper onto which an image or indicia is to be copied in a xerographic copying process. As explained in my co-pending application, I have determined that, by the use of a suitable paper feeding system in which paper from a roll is continuously fed into a conventional xerographic copying machine adapted to concurrently feed an elongated fan-folded original document, the indicia from the original document can be copied continuously onto the elongated sheet thus continuously fed through the machine from the roll.

Because of the manner in which well logs and computer printouts are stored, and the manner in which they are customarily opened out for reading, copies of such logs and printout documents made by the process described in my co-pending application must be fan-fold to achieve acceptability in the market-place.

When the procedure described in my co-pending application is utilized, and an elongated roll of paper is fed through the xerographic copying maching to duplicate elongated Z-fold original paper documents, such as well logs and computer printouts, it is then necessary to either purchase a complicated machine for Z-folding the copy, or as is more widely and frequently done, to manually Z-fold the copied document. Manual Z-folding of the copy is tedious work, and care must be exercised that each fold line made in the copied document extends precisely transversely across the document, and that the fold lines are exactly equally spaced from each other. Otherwise the document will not, in the final product, be folded neatly and compactly, with each of the panels precisely superimposed on top of the others. At times, also, misfolds are made, thus creasing the paper at an improper location, and a new fold line has to be made that is at the right location. When the improper fold line has been made, however, it is not possible to eliminate the improper first crease from the paper at that point. In sum, the Z-folded products resulting from the manual folding procedure are frequently not well folded, are shoddy and unsymmetrical in appearance, and sometimes fail to unfold quickly and easily for use when the copied indicia is to be perused. Employment of a Z-folding machine for this purpose is, moreover, quite expensive, and the machine is subject to occasional malfunction resulting in tearing or slitting of the document, thus damaging its physical integrity.

In attempting to alleviate the problems encountered in ultimately producing a Z-folded copy of the elongated original document, an attempt has been made to directly feed Z-folded paper produced by the perforating process described in referring to FIG. 1 directly out of the Z-fold stack into the xerographic copying machine, in the hope that the pre-perforated, pre-crimped paper would facilitate the subsequent placement of folds at the proper location, and render the Z-folding manula procedure more accurate while requiring less care and less time to accomplish the final Z-folding of the document copy. These attempts, however, have not been successful. The presence of the pre-formed score lines in the paper thus fed to the xerographic copying machine causes skips in the indicia transfer process within a small area extending approximately ⅛ inch to ¼ inch on opposite sides of each of the score lines. At this location, the malfunction in indicia transfer is due to the inability of the pre-scored paper to pass smoothly over the periphery of the rotating xerographic drum at the angulation formed at each score line by the scoring process.

I have now determined that by pre-rolling the prescored or perforated bond paper of the specified weight range in the manner illustrated in FIG. 1 so as to produce the roll 41, and then utilizing this roll to feed the pre-scored paper to a xerographic copying machine, the elongated pre-scored sheet of copy paper is tensioned sufficiently, in addition to the pre-flattening effect, that no gaps or holidays are formed in the transferred indicia within the skip zones previously existent adjacent each score line. Thus, the transfer of indicia is complete and accurate with a high degree of fidelity, and the desirable aspect of pre-scoring and pre-crimping the paper is retained.

Figure 4:
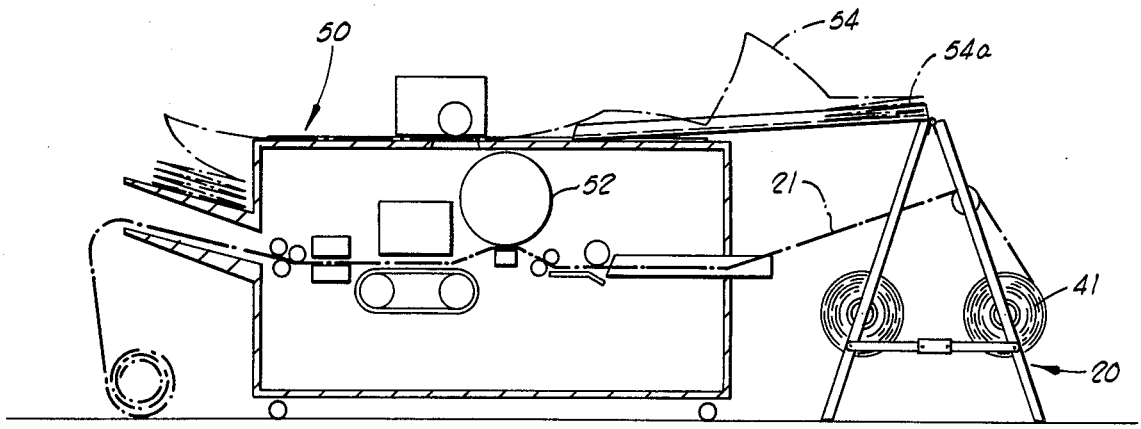
FIG. 4 is a view partially in elevation and partially in section illustrating a roll-feeding subassembly used for feeding the roll of elongated perforated paper sheet to a xerographic copying machine of the type which employs a large drum in the course of xerographically reproducing indicia on a sheet from a concurrently fed original document.

This procedure is illustrated in FIG. 4 of the drawings where the pre-scored, pre-folded paper sheet 21 is shown being fed from the roll 41 through a xerographic copying machine 50 which includes the usual large, rotatably mounted copying drum 52. The sheet 21 is shown being passed beneath the drum 52 in the manner described generally in my co-pending application Ser. No. 907,922. A Z-folded original document 54 is being transferred from the Z-fold stack 54*a* to a location beneath the imaging section of the copying machine for the purpose of permitting the indicia to be copied therefrom onto the sheet 21. As the pre-scored sheet 21 is discharged from the xerographic copying machine, it can be rolled up at that time preparatory to subsequent manual Z-folding.

With respect to manual folding of the elongated copy 21 into its final Z-fold configuration, I have determined that the prescored paper, when scored in the manner described, apparently retains sufficient memory of the perforating and crimping force applied at the alternating score lines that the sheet 21, following the transfer of the indicia thereto, tends to distort toward the Z-fold configuration, and very little skill or attention to detail is required to achieve the final Z-fold product. A great deal of time is saved by the described process in the tedious task of Z-folding the elongated final document copy to a form in which it is readily usable.

I have determined that in the case of the 16–32 pound bond paper used in the practice of the invention, a crimping force which will cause the paper to permanently angulate out of a monoplanar configuration at the score lines is adequate to provide a Z-fold memory which enables manual folding to be accomplished neatly and with little error. Preferably, however, the precrimping or pre-folding moves the panels of the paper sheet on opposite sides of each score line into an angular relationship to each other of less than 90°, and in the most effective and optimum practice of the invention, these adjacent panels are actually superimposed, i.e., a fold of 180° at each fold line is made. When this is accomplished, the final copy will practically fall into a Z-fold, stacked configuration.

One method of accomplishing the 180° fold at each fold line is by the use of the auger or spiral type folder 39 shown in FIG. 1 as located between the perforating machine and the rolling subassembly. Such paper folders are well known in the graphic art technology, and function to fold the elongated sheet into adjacent superimposed panels.

Although a preferred embodiment of the invention has been herein described in order to clearly illustrate the principles of the invention, it will be understood that various changes and innovations in the described procedure, and in the apparatus utilized, can be effected without departure from the principles underlying the invention. Thus, various types of paper roll mounting and feeding assemblies could be utilized other than those herein described, and the types of scoring and zerographic copying machines used in the process may vary widely. Generally, it is contemplated that the process applies to the types of copying machines which employ large xerographic copying drums which are positioned in close proximity to the paper sheet upon which the indicia is to be transferred as it is passed through the machine. Changes and innovations of the type described can be made without relinguishment of reliance on the principles underlying the invention, and are deemed to be circumscribed by the spirit and scope of the invention, except as the same may be necessarily limited by the appended claims, or reasonable equivalents thereof.

What is claimed is:

1. A method for producing elongated Z-fold 16–32 pound bond copy paper having indicia emplaced thereon by xerographic reproduction comprising:

transversely scoring and crimping an elongated sheet of copy paper at longitudinally spaced intervals therealong with longitudinal spaced score lines alternately originated by perforating pressures applied to alternately opposed respective sides of the paper sheet to thereby form the sheet with panels on opposite sides of the spaced score lines, said sheet being at least partially fan-folded so that respective panels on opposite sides of a score line extend at an angle of less than 180° with respect to one another; subsequently, rolling the scored and crimped paper sheet into a cylindrical roll; and feeding the scored paper sheet from the roll through a copying machine concurrently with the placement of an original document in the copying machine to transfer indicia from the original document to the sheet of copy paper.

2. The method defined in claim 1 and further characterized as including the step, carried out prior to rolling the scored paper into a cylindrical roll, of folding the scored, crimped elongated sheet into a plurality of pairs of adjacent panels extending at angles of less than 90° to each other in a generally fan-fold configuration.

3. The method defined in claim 2 wherein said panels are folded to a superimposed position.

4. The method defined in claim 2 and further characterized as including the step of folding the score copy paper having the transferred indicia thereon into a Z-folded stack of contiguous panels each bounded by score lines.

5. The method defined in claim 2 wherein each of said score lines includes within its length from about 50 percent to about 80 percent of its total length as open perforations and the remainder of its total length as unperforated webs between perforations.

6. The method defined in claim 2 wherein during the feeding of the scored paper sheet through the copying machine, the scored paper sheet is passed in close proximity to a xerographic drum.

7. In a process for xerographically copying indicia from an elongated document of indeterminate length onto an elongated sheet of 16–32 pound bond copy paper to be manually fan-folded after completion of the copying, which process entails continuously and concurrently feeding both the document and copy paper to a copying machine, the improvement which comprises:

pre-stressing the copy paper along longitudinally spaced, transversely extending perforated fold lines to induce a fan-fold memory in the elongated copy paper; then rolling the pre-stressed copy paper having the fan-fold memory into a cylindrical roll; and carrying out the feeding of the copy paper to the copying machine by feeding the pre-stressed roll of copy paper from the cylindrical roll into the copy machine as the cylindrical roll unwinds.

8. Apparatus used for producing Z-fold copy paper comprising:

a first feed subassembly for feeding an elongated sheet of paper from a roll into a perforating machine;

a perforating machine connected to said first feed subassembly for receiving an elongated sheet of paper therefrom and for alternately perforating opposite sides of the sheet of paper at spaced intervals therealong, said perforating machine including:

a first perforating element; and a second perforating element spaced from said first perforating element;

means for fan-folding the paper along perforation lines formed therein;

a paper rolling machine for rolling the perforated and folded paper into a cylindrical roll upon receipt of the perforated paper from the perforating machine and folding means;

a copying machine containing a rotating xerographic drum; and a roll feeding subassembly for feeding the perforated paper from the roll into said copying machine, and means in said copying machine for drawing said perforated paper past said rotating xerographic drum.

9. A roll of elongated, pre-stressed, perforated xerographic copy paper comprising:

a series of integrally formed, interconnected panels, the panels of each adjacent pair of panels having a pre-stressed zone between the two panels in the respective pair, each zone having an elastic memory which causes adjacent panels to rotate about an axis in said zone in one of two directions wherein said panels in each of the pairs of panels extend at an angle of less than 180° with respect to one another when the paper is in an unrolled, substantially untensioned state, successive memories in the series of interconnected panels alternating in their direction of stress-force application causing said panels to collectively form a fan-fold configuration in the copy paper when said substantially untensioned state; and score lines each including a line of spaced perforations, and each extending transversely across the elongated copy paper at the line of intersection between the panels in each pair of adjacent panels said paper roll being in a coiled cylindrical configuration.

10. The method of making an improved roll of an elongated sheet of copy paper comprising:

forming a plurality of longitudinally spaced, transversely extending score lines in the sheet prior to rolling the sheet;

fan-folding the sheet by alternately folding the sheet in first one direction, and then the opposite direction, along the several score lines at a time prior to rolling the sheet; then rolling the scored and folded paper into a roll.

11. The method defined in claim 10 wherein said forming of said score lines and alternate folding of the sheet is carried out concurrently by exerting a force accomplishing said scoring and folding to alternately opposite sides of the sheet of paper at each pair of adjacent score line loci.

* * * * *

UNITED STATES PATENT AND TRADEMARK OFFICE

CERTIFICATE OF CORRECTION

PATENT NO. : B1 4,270,911

DATED : March 19, 1985

INVENTOR(S) : Thomas A. McNew

It is certified that error appears in the above-identified patent and that said Letters Patent are hereby corrected as shown below:

Claim 18 should not appear in the patent.

Signed and Sealed this

Thirteenth Day of August 1985

[SEAL]

*Attest:*

DONALD J. QUIGG

*Attesting Officer*

*Acting Commissioner of Patents and Trademarks*

REEXAMINATION CERTIFICATE (316th)

United States Patent [19]

McNew

[11] B1 4,270,911

[45] Certificate Issued Mar. 19, 1985

[54] METHOD AND SYSTEM FOR PROVIDING ELONGATED Z-FOLD COPY PAPER

[75] Inventor: Thomas A. McNew, Oklahoma City, Okla.

[73] Assignee: Digital Magnetic Systems, Inc., Oklahoma City, Okla.

Reexamination Request:
No. 90/000,139, Jan. 21, 1982

Reexamination Certificate for:

| | |
|---|---|
| Patent No.: | **4,270,911** |
| Issued: | **Jun. 2, 1981** |
| Appl. No.: | **104,445** |
| Filed: | **Dec. 17, 1979** |

[51] Int. Cl.[3] ..... B65H 45/00; B65H 45/20

[52] U.S. Cl. ..... 493/410; 493/413; 493/448; 355/35 H; 355/145 H; 428/130; 428/169

[58] Field of Search ..... 493/363, 493/409, 410, 411, 412; 271/4; 226/109; 355/3 SH, 2, 72; 346/136; 400/613.2, 613.3, 613.4; 206/390; 428/43, 153, 154; 229/69; 281/5; 282/11.5 R, 11.5 A, 12 A

[56] References Cited

U.S. PATENT DOCUMENTS

| | | | |
|---|---|---|---|
| 946,393 | 1/1910 | Nichols . | |
| 1,010,437 | 12/1911 | Klein . | |
| 1,090,304 | 3/1914 | Hildebrandt . | |
| 1,753,764 | 4/1930 | Willard . | |
| 1,823,475 | 9/1931 | Scudds | 493/363 |
| 2,023,357 | 12/1935 | Harvey . | |
| 2,143,622 | 1/1939 | Fulk . | |
| 2,246,234 | 6/1941 | Antrim . | |
| 2,353,982 | 7/1944 | Young . | |
| 2,620,205 | 12/1952 | Vogt . | |
| 2,854,233 | 9/1958 | Groeper . | |
| 2,870,840 | 1/1959 | Kwitek | 83/342 |
| 2,907,585 | 10/1959 | Sornberger et al. . | |
| 3,092,401 | 6/1963 | Steidinger . | |
| 3,104,799 | 9/1963 | Steidinger . | |
| 3,245,311 | 4/1966 | Cerasani et al. . | |
| 3,406,959 | 10/1968 | Ross | 493/359 |
| 3,460,825 | 8/1969 | Mets et al. | 493/410 |
| 3,547,752 | 12/1970 | Janssen | 281/5 X |
| 3,554,438 | 1/1971 | von Malderghem . | |
| 3,631,972 | 1/1972 | Gendron et al. . | |
| 3,701,522 | 10/1972 | Chi | 270/39 |
| 3,804,514 | 4/1974 | Jasinski . | |
| 3,825,463 | 7/1974 | Amann | 260/390 X |
| 3,967,776 | 7/1976 | Getsch . | |
| 3,973,846 | 9/1974 | Sullivan et al. . | |
| 3,978,491 | 8/1976 | Lenhart et al. | 206/390 X |
| 4,086,007 | 4/1978 | Smith et al. | 355/3 R |
| 4,108,352 | 8/1978 | Peschke | 229/69 |

FOREIGN PATENT DOCUMENTS 790434 7/1968 Canada .

OTHER PUBLICATIONS

Xerographic Accessory Price List, 3/30/77.
ABM Product & Price List, ABM Inc., 1312A Cornell Pkwy., Oklahoma City, OK.
Ridgway's Product & Price List, 12/11/78.

*Primary Examiner*—Steven A. Bratlie

[57] ABSTRACT

A method and system for producing elongated Z-fold copy paper having indicia emplaced thereon by xerographic reproduction. The method entails initially transversely scoring and folding an elongated sheet of paper at spaced intervals therealong with alternate adjacent score-fold lines being originated by pressures exerted on respectively opposite sides of the paper. The elongated scored sheet is then rolled up in a cylindrical roll, and is fed from this roll to a copying machine into close proximity to a rotating xerographic copying drum within the machine. After emplacement of indicia on the paper in the reproduction process, the paper may then be rolled up on a storage roll or Z-folded manually or by suitable apparatus.

The apparatus used to produce the elongated Z-fold copy paper includes a first paper feed subassembly for feeding an elongated sheet of paper from a roll into a perforating machine, a perforating machine for alternately perforating opposite sides of the sheet of paper at spaced intervals therealong, and including a first perforating element and a second perforating element spaced from the first perforating element, a paper rolling machine for rolling the perforated paper into a cylindrical roll upon receipt of the perforated paper from the perforating machine, a roll feeding subassembly for feeding perforated paper from the roll to a xerographic drum-containing copying machine, and a xerographic drum-containing copying machine for receiving the perforated paper from the roll feeding subassembly.

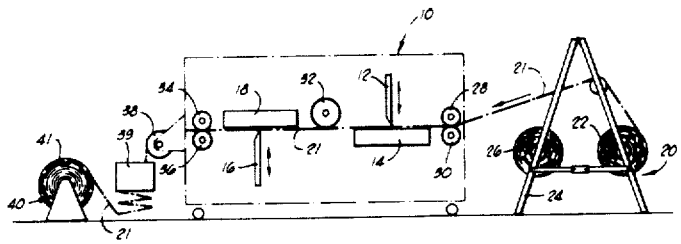

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2 line 43:

*As used herein the term scoring is used to mean cutting aligned perforations through a part of the paper.*

Column 5 lines 11–16:

Because of the manner in which well logs and computer printouts are stored, and the manner in which they are customarily opened out for reading, copies of such logs and printout documents made by the process described in my co-pending application must be [fan-fold] *fan-folded* to achieve acceptability in the marketplace.

AS A RESULT OF REEXAMINATION, IT HAS BEEN DETERMINED THAT:

The patentability of claims 7 and 8 is confirmed.

Claims 1, 9 and 10 are determined to be patentable as amended.

Claims 2–6 and 11, dependent on an amended claim, are determined to be patentable.

New claims 12–19 are added and determined to be patentable.

1. A method for producing elongated Z-fold 16–32 pound bond copy paper having indicia emplaced thereon by xerographic reproduction comprising:

transversely scoring and crimping an elongated sheet of copy paper at longitudinally spaced intervals therealong with longitudinal spaced score lines alternately originated by perforating pressures applied to alternately opposed respective sides of the paper sheet to thereby form the sheet with panels on opposite sides of the spaced score lines, said sheet being at least partially fan-folded so that respective panels on opposite sides of a score line extend at an angle of less than 180° with respect to one another; subsequently, rolling the scored and crimped paper sheet into a cylindrical roll; and feeding the scored paper sheet from the roll through a *xerographic* copying machine concurrently with the placement of an original document in the copying machine to transfer indicia from the original document to the sheet of copy paper.

9. A roll of elongated, pre-stressed, perforated xerographic copy paper comprising:

a series of integrally formed, interconnected panels, the panels of each adjacent pair of panels having a pre-stressed zone between the two panels in the respective pair, each zone having an elastic memory which causes adjacent panels to rotate about an axis in said zone in one of two directions wherein said panels in each of the pairs of panels extend at an angle of less than 180° with respect to one another when the paper is in an unrolled, substantially untensioned state, successive memories in the series of interconnected panels alternating in their direction of stress-force application causing said panels to collectively form a fan-fold configuration in the copy paper when *in* said substantially untensioned state; and score lines each including a line of spaced perforations, and each extending transversely across the elongated copy paper at the line of intersection between the panels in each pair of adjacent panels said paper roll being in a coiled cylindrical configuration.

10. The method of making an improved roll of an elongated sheet of copy paper comprising:

forming a plurality of longitudinally spaced, transversely extending score lines in the sheet prior to rolling the sheet[;], *wherein each of said score lines is formed by a plurality of transversely aligned, spaced perforations;* fan-folding the sheet by alternately folding the sheet in first one direction, and then the opposite direction, along the several score lines at a time prior to rolling the sheet; then rolling the scored and folded paper into a roll.

*12. The improvement in a process of xerographically copying indicia from an elongated document of indeterminate length as defined in claim 7 wherein said transversely extending lines are formed in the paper by placing transversely aligned perforations transversely across the paper at longitudinally spaced intervals, with adjacent perforations in each transverse alignment of perforations being separated by paper not perforated, the perforations in each transverse alignment occupying from about 50% to about 80% of the total transverse width of the paper.*

*13. The improvement in a process for xerographically copying indicia from an elongated document of indeterminate length as defined in claim 7 and further characterized as including the step of pulling the copy paper to and through said copying machine from said cylindrical roll to induce a tension in that part of the paper passing through the copy machine and traversing a point of indicia image transfer to the copy paper to thereby remove from the plane of the copy paper, tents and valleys occurrent in the copy paper prior to rolling as a result of the preliminary pre-stressing to induce the fan-fold memory in the elongated copy paper.*

*14. The method of making an improved roll of an elongated sheet of copy paper as defined in claim 10 whereby rolling the sheet into a roll concurrently tensions and flattens the paper sheet to flatten out portions of the sheet adjacent each of the score-fold lines into a substantially uncrimped configuration so that failure of indicia transfer to an area adjacent the score-fold lines in the course of a copying process is obviated.*

*15. The method of making an improved roll of an elongated sheet of copy paper as defined in claim 10 wherein in fan-folding the sheet, said sheet is folded through an angle of more than 90° at each score line.*

*16. The method of making an improved roll of an elongated sheet of copy paper as defined in claim 15 wherein*

*said sheet is folded through an angle of 180° into a form constituted by a plurality of superimposed flat panels prior to rolling the scored and folded paper into a roll.*

*17. A method for producing Z-fold copy paper having copied indicia thereon comprising:*

*feeding an elongated single thickness sheet of paper from a roll into a perforating machine;*

*perforating said elongated sheet of paper at longitudinally spaced intervals therealong by the use of perforating elements in said perforating machine to form transverse perforation lines therein;*

*pre-stressing the copy paper along said longitudinally spaced, transverse perforation lines to induce a fan-fold memory in the paper along the perforation lines;*

*rolling the pre-stressed, perforated copy paper having the fan-fold memory therein into a cylindrical roll after the perforating and pre-stressing steps;*

*feeding the perforated paper under tension from the roll into a xerographic copying machine into proximity to an cylindrical image transfer drum contained therein; and*

*transferring copied indicia onto said paper in a continuous, uninterrupted form crossing a plurality of said transversely extending fan-fold perforation lines; then*

*withdrawing said copy paper from the copy machine; and*

*folding the copy paper into a Z-fold configuration.*

*18. The method of making an improved roll of an elongated sheet of copy paper comprising:*

*forming a plurality of longitudinally spaced, transversely extending score lines in the sheet prior to rolling the sheet;*

*fan folding the sheet by alternately folding the sheet in first one direction, and then the opposite direction, along the several score lines at a time prior to rolling the sheet; then*

*rolling the scored and folded paper into a roll whereby said score line formation, coupled with rolling of the scored and folded paper, affects the folds in the sheet so that the copy paper can pass smoothly from the roll over a rotating xerographic copying drum without failure of indicia transfer at the locus of the fold lines.*

*19. The method defined in claim 17 wherein said elongated sheet of paper is perforated by forming aligned transversely spaced perforations each extending completely through the sheet of paper, and separated from each other by unperforated webs of paper, each of said perforation lines including perforations in a size and number such that the total dimensional width of all the perforations in each perforation line is from about 50% to about 80% of the total transverse width of the paper, and the remainder of such total transverse paper width is occupied by said unperforated webs of paper; and*

*wherein said pre-stressing to induce fan-fold memory is accomplished by folding the single sheet of paper through an angle of more than 90° at each transverse perforation line.*

* * * * *